United States Patent [19]

Yoshino

[11] Patent Number: 4,938,023

[45] Date of Patent: Jul. 3, 1990

[54] SWING-FRAME MOTOR FLOW AND SENSED LOAD PRESSURE CONTROL SYSTEM FOR HYDRAULIC EXCAVATOR

[75] Inventor: Kazunori Yoshino, Kobe, Japan

[73] Assignee: Shin Caterpillar Mitsubishi Ltd., Tokyo, Japan

[21] Appl. No.: 245,049

[22] Filed: Sep. 15, 1988

[30] Foreign Application Priority Data

Sep. 29, 1987 [JP] Japan ..... 62-242744

[51] Int. Cl.[5] ..... E02F 9/22

[52] U.S. Cl. ..... 60/427; 60/420; 60/452; 91/518; 91/529; 91/531; 414/687

[58] Field of Search ..... 60/420, 422, 426, 427, 60/450, 452, 459, 484; 91/517, 518, 526, 528, 529, 513, 530, 531; 414/687, 694; 37/DIG. 9

[56] References Cited

U.S. PATENT DOCUMENTS

| | | | |
|---|---|---|---|
| 4,449,366 | 5/1984 | Sato et al. | 60/420 X |
| 4,523,430 | 6/1985 | Masuda | 60/420 |
| 4,573,319 | 3/1986 | Chichester | 60/420 |
| 4,665,698 | 5/1987 | Trusock | 60/420 |
| 4,738,103 | 4/1988 | Tha | 60/427 |
| 4,739,617 | 4/1988 | Kreth et al. | 60/427 X |

FOREIGN PATENT DOCUMENTS

| | | | |
|---|---|---|---|
| 111208 | 6/1984 | European Pat. Off. | 60/452 |
| 174707 | 10/1983 | Japan | 91/530 |
| 43202 | 3/1984 | Japan | 60/452 |
| 43203 | 3/1984 | Japan | 60/452 |
| 54801 | 3/1984 | Japan | 60/452 |

*Primary Examiner*—Robert E. Garrett
*Assistant Examiner*—George Kapsalas
*Attorney, Agent, or Firm*—Beveridge, DeGrandi & Weilacher

[57] ABSTRACT

A fluid pressure control system comprising a first selector valve for controlling the action of a first actuator, a second selector valve for controlling the action of a second actuator, a first flow control valve for controlling a fluid to be supplied to the first actuator, and a second flow control valve for controlling a fluid to be supplied to the second actuator. A pressure reducing valve is provided for reducing the pressure of the fluid supplied to the second actuator. The pressure on the outlet side of the pressure reducing valve is controlled by the proportional pressure relief valve which is controlled by an external pilot pressure. This system is applicable, for example, to a hydraulic excavator.

11 Claims, 5 Drawing Sheets

SWING-FRAME MOTOR FLOW AND SENSED LOAD PRESSURE CONTROL SYSTEM FOR HYDRAULIC EXCAVATOR

BACKGROUND OF THE INVENTION

1. Field of the Invention

This invention relates to a fluid pressure control system for controlling a plurality of actuators. More specifically, it relates to a fluid pressure control system suitable for, but not exclusively, controlling the actuation of a fluid pressure cylinder mechanism for vertically moving a boom and a fluid pressure motor for swinging an upper swing frame in a hydraulic excavator.

2. Description of the Prior Art

A hydraulic excavator is provided with an upper swing frame mounted pivotally on a moving undercarriage, a boom mounted on the upper swing frame for free vertical movement and a bucket mounted pivotally on the end portion of the boom via an arm. The upper swing frame is caused to swing by the action of the fluid pressure motor, and the boom is actuated vertically by the extension and retraction of a fluid pressure cylinder mechanism for the boom. The bucket is actuated by the extension and retraction of a fluid pressure cylinder mechanism for the bucket. The following problems to be solved, which will be described in detail later on, exist with the fluid control system provided in a conventional hydraulic excavator. First, when the rotation of the fluid pressure motor is restricted by the resistance of an external load, the fluid pressure supplied to the fluid pressure motor abruptly increases to swing the upper swing frame with a strong torque. Consequently, the fine-controllability of the upper swing frame is aggravated. Secondly, when, for example, the fluid pressure cylinder mechanism for the boom and the fluid pressure motor for swing are actuated in full motion simultaneously, the rotation of the shaft of the fluid pressure motor tends to be regulated at the time of starting the swinging of the upper swing frame. This regulated rotation abruptly increases the fluid pressure supplied to the fluid pressure motor, and the upper swing frame moves at a relatively high speed. Thus, the swinging speed of the upper swing frame becomes much faster than the lifting speed of the boom.

SUMMARY OF THE INVENTION

It is a primary object of this invention to provide an excellent fluid pressure control system in which even if a large external load acts on an actuator, the fluid pressure supplied to the actuator can be prevented from rising abruptly.

According to this invention, there is provided a fluid pressure control system comprising a variable displacement pump of which amount of discharge is variable, a first selector valve adapted to be selectively held at any one of a neutral position, a first operative position and a second operative position, a second selector valve adapted to be selectively held at any one of a neutral position, a first operative position and a second operative position, a first actuator of which action is to be controlled by the shifting operation of the first selector valve, a second actuator of which action is to be controlled by the shifting operation of the second selector valve, a first flow control valve for controlling a fluid to be supplied to the first actuator, a second flow control valve for controlling a fluid to be supplied to the second actuator, a feed flow passage connecting the variable displacement pump to the first and second selector valves, a return flow passage connected to the first and second selector valves, a first and a second flow passage connecting the first selector valve to the first actuator, a third and a fourth flow passage connecting the second selector valve to the second actuator, and a main load-detecting flow passage for controlling the amount of discharge of the variable displacement pump, the first selector valve at the first operative position permitting communication of the feed passage with the first flow passage and also the return flow passage with the second flow passage, the first selector valve at the second operative position permitting communication of the feed passage with the second flow passage and also the return flow passage with the first flow passage, the first selector valve at the neutral position shutting off communication of the feed flow passage and the return flow passage with the first flow passage and the second flow passage, the second selector valve at the first operative position permitting communication of the feed passage with the third flow passage and also the return flow passage with the fourth flow passage, the second selector valve at the second operative position communication of the feed passage with the fourth flow passage and also the return flow passage with the third flow passage, the second selector valve at the neutral position shutting off communication of the feed flow passage and the return flow passage with the third flow passage and the fourth flow passage, the first flow control valve being adapted to control a fluid to be supplied to the first or second flow passage from the feed flow passage when the first selector valve is at the first or second operative position, and the second flow control valve being adapted to control a fluid to be supplied to the third or fourth flow passage from the feed flow passage when the second selector valve is at the first or second operative position;

wherein a pressure reducing valve and a relief valve are disposed in relation to the second flow control valve, the pressure reducing valve reduces the pressure of the fluid supplied to the second actuator through the second selector valve, and the outlet pressure of the pressure reducing valve is controlled by the relief valve which is controlled by an external pilot pressure.

DETAILED DESCRIPTION OF THE PREFERRED EMBODIMENTS

One embodiment of the fluid pressure control system constructed in accordance with this invention will be described with reference to the accompanying drawings.

Figure 1:
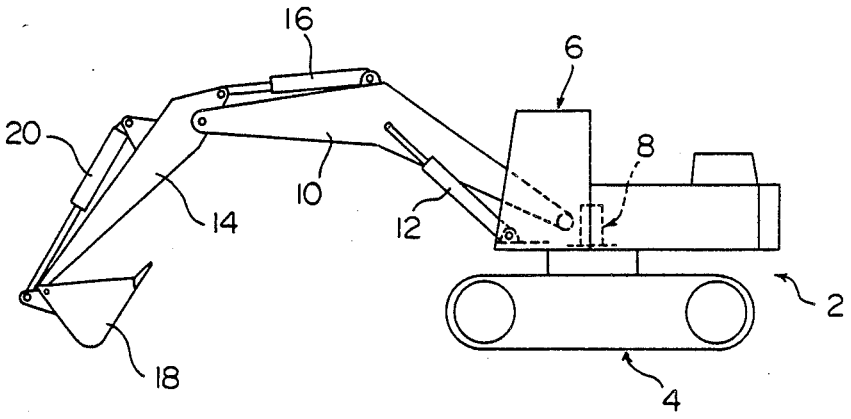
FIG. 1 is a simplified view showing one example of a hydraulic excavator equipped with one embodiment of the fluid pressure control system in accordance with this invention.

In FIG. 1, the illustrated hydraulic excavator is provided with a vehicle body shown at 2 having a moving undercarriage 4 which may be formed by tracks. An upper swing frame 6 is mounted on the upper end portion of the vehicle body 2 so as to be free to swing about a vertically extending pivot axis, and adapted to swing in the manner to be described by the action of a fluid pressure motor 8 such as a hydraulic motor. One end portion of a boom 10 is pivotally mounted on the upper swing frame 6, and a fluid pressure cylinder mechanism 12 for the boom, such as a hydraulic cylinder, is interposed between the boom 10 and the upper swing frame 6. Accordingly, when the fluid pressure cylinder mechanism 12 is extended (or retracted), the boom 10 moves upwardly (or downwardly). An arm 14 is pivotally mounted on the other end portion of the boom 10, and a fluid pressure cylinder mechanism 16 for the arm is interposed between the boom 10 and the arm 14. A bucket 18 as a working device is mounted pivotally on the front end portion of the arm 14. A fluid pressure cylinder mechanism 20 for the bucket is interposed between the arm 14 and the bucket 18. Hence, the arm 14 and the bucket 18 are actuated by the extension and retraction of the fluid pressure cylinder mechanisms 16 and 20.

Figure 2:
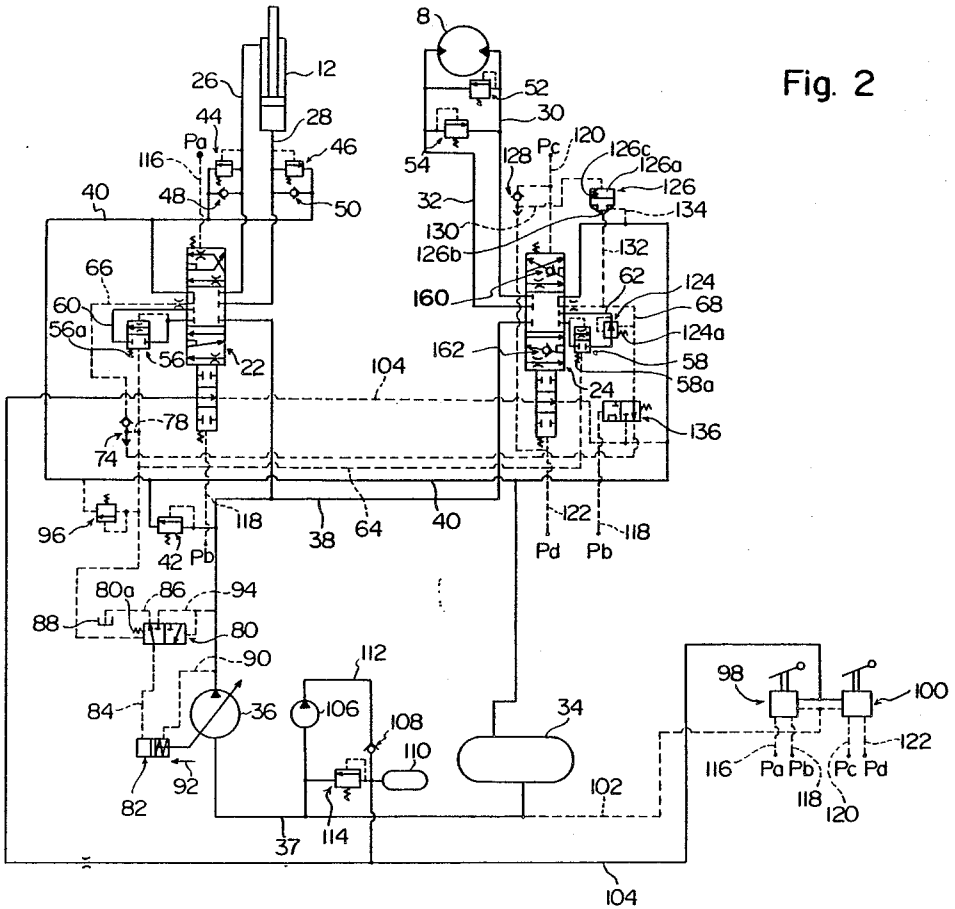
FIG. 2 is a fluid pressure circuit diagram showing one embodiment of the fluid pressure control system in accordance with this invention.

The operations of the fluid pressure motor 8 and the fluid pressure cylinder mechanism 12 for the boom in the hydraulic excavator are controlled by the fluid pressure control system shown in FIG. 2. The fluid pressure cylinder mechanism 16 for the arm, the fluid pressure cylinder mechanism 20 for the bucket and fluid pressure motors in the moving undercarridge are also controlled by the fluid pressure control system shown in FIG. 2. But for easy understanding, these members are omitted in FIG. 2.

In FIG. 2, the illustrated fluid pressure control system is equipped with a first selector valve 22 for controlling the operation of the fluid pressure cylinder mechanism 12 (constituting a first actuator) for the boom and a second selector valve 24 for controlling the operation of the fluid pressure motor 8 (constituting a second actuator). The first selector valve 22 and the retracting side (rod side) of the fluid pressure cylinder mechanism 12 are connected via a first flow passage 26, and the first selector valve 22 and the extending side (head side) of the fluid pressure cylinder mechanism 12 are connected via a second flow passage 28. The second selector valve 24 is connected to one connecting portion of the fluid pressure motor 8 via a third flow passage 30, and to the other connecting portion of the fluid pressure motor 8 via a fourth flow passage 32.

The illustrated system further comprises a fluid reservoir such as an oil tank and a supply source for supplying a fluid in the fluid reservoir 34. The supply source is constructed of a variable displacement pump 36 of which amount of discharge is variable. The fluid reservoir 34 and the variable displacement pump 36 are connected via a supply flow passage 37. The variable delivery pump 36 is connected to the first switch valve 22 and the second selector valve 24 via feed flow passage 38. The fluid reservoir 34 is connected to the first selector valve 22 and the second selector valve 24 via a return flow passage 40. The feed flow passage 38 and the return flow passage 40 are connected via a relief valve 42. Hence, when the fluid pressure in the feed flow passage 38 exceeds a preset value, the relief valve 42 is opened to permit the fluid in the feed flow passage to flow to the return flow passage 40 via the relief valve 42. The first flow passage 26 and the return flow passage 40 are connected via a relief valve 44, and the second flow passage 28 and the return flow passage 40 are connected via a relief valve 46. The relief valve 44 (or 46) is opened when the fluid pressure in the first flow passage 26 (or the second flow passage 28) exceeds a preset value to conduct the fluid in the first flow passage 26 (or the second flow passage 28) to the return flow passage 40. In the illustrated embodiment, a check valve 48 is disposed between the first flow passage 26 and the return flow passage 40 bypassing the relief valve 44, and a check valve 50 is likewise disposed between the second flow passage 28 and the return flow passage 40 bypassing the relief valve 46. The third flow passage 30 and the fourth flow passage 32 are connected via relief valves 52 and 54. The relief valve 52 (or 54) is opened when the fluid pressure in the third flow passage 30 (or the fourth flow passage 32) exceeds a preset value to conduct the fluid in the third flow passage 30 (or the fourth flow passage 32) to the fourth flow passage 32 (or the third flow passage 30).

A first flow control valve 56 and a second flow control valve 58 are annexed to the first selector valve 22 and the second selector valve 24, respectively. Both end portions of a fifth flow passage 60 are connected to the first selector valve 22, and the first flow control valve 56 is disposed in the fifth flow passage 60. The first flow control valve 56 is adapted to be selectively held at a shutting position at which it shuts off the fifth flow passage 60 and an open position at which it opens the fifth flow passage 60. Both end portions of a sixth flow passage 62 are connected to the second selector valve 24, and the second flow control valve 58 is disposed in the sixth flow passage 62. The second flow control valve 58 is adapted to be held selectively at a shutting position at which it shuts off the sixth flow passage 62 and an open position at which it opens the sixth flow passage 62. In the illustrated embodiment, the fluid pressure in a main load-detecting flow passage 64 acts as a pilot pressure on the first flow control valve 56 and the second flow control valve 58. Accordingly, the first flow control valve 56 is brought from the shutting position to the opening position when the primary fluid pressure exceeds the sum of the pilot pressure acting on it (the fluid pressure in the main load-detecting flow passage 64) and the pressure of a spring 56*a*, thereby permitting feeding of the fluid through the fifth flow passage 60. The second flow control valve 58 is brought from the shutting position to the opening position when the primary fluid pressure exceeds the sum of the pilot pressure acting on it (the fluid pressure in the main load-detecting flow passage 64) and the pressure of a spring 58*a*, thereby permitting feeding of the fluid through the sixth flow passage 62. Since, as shown in FIG. 2, the first flow control valve 56 and the second flow control valve 58 include orifices, the flow rate of a fluid fed through the first flow control valve 56 or the second flow control valve 58 is regulated by the throttling action of the orifices.

Load-detecting flow passage 66 and 68 are connected to the first selector valve 22 and the second selector valve 24, respectively. The load-detecting flow passage 66 is connected to a shuttle valve 74. The load detecting flow passage 68 is connected to the shuttle valve 74 which is connected to the main load-detecting flow passage 64 via a flow passage 78. The shuttle valve 74 transmits the fluid pressure in the load detecting flow passage 66 or the fluid pressure in the load detecting flow passage 68, whichever is higher, to the flow passage 78 and therefore to the main load-detecting flow passage 64.

The fluid pressure in the main load-detecting flow passage 64 acts as a pilot pressure on a selector valve 80 for load detection. The fluid pressure in the feed flow passage 38 also acts as a pilot pressure on the selector valve 80. It will be understood from FIG. 2 that when the sum of the fluid pressure in the main load-detecting flow passage 64 and the pressure of a spring 80*a* in the selector valve 80 is higher than the fluid pressure in the feed flow passage 38, the selector valve 80 is at a first position shown in the drawing, and a fluid in a chamber at one side portion of a cylinder 82 for adjustment of the amount of discharge is returned to a fluid reservoir 88 through a flow passage 84, the selector valve 80 and a flow passage 86 (whereby the fluid in the feed flow passage 38 is fed to the other chamber containing a spring in the cylinder 83 via a flow passage 90). Thus, the output portion of the cylinder 82 moves to an amount increasing side shown by an arrow 92, and the amount of discharge from the variable displacement pump 36 increases. On the other hand, when the sum of the fluid pressure in the main load-detecting flow passage 64 and the pressure of the spring 80*a* of the selector valve 80 is lower than the fluid pressure in the feed flow passage 38, the selector valve 80 is shifted from the first position to a second position at which it permits communication of the flow passage 84 with a flow passage 94. As a result, the fluid in the feed flow passage 38 is fed into the aforesaid chamber on one side in the cylinder 82 through the flow passage 94, the selector valve 80 and the flow passage 84 (whereby the fluid in the other chamber of the cylinder 82 is returned to the feed flow passage 38 through the flow passage 90). As a result, the output portion of the cylinder 82 moves to an amount decreasing side in a direction opposite to the direction of arrow 92, and the amount of discharge from the variable displacement pump 36 is decreased. A relief valve 96 is disposed between the main load-detecting flow passage 64 and the return flow passage 40. When the fluid pressure in the main load-detecting flow passage 64 exceeds a preset value, the relief valve 96 is opened to conduct the fluid in the main load-detecting flow passage 64 to the return flow passage 40.

The first selector valve 22 and the second selector valve 24 in the illustrated embodiment are operated by an external pilot pressure. A pilot valve 98 is provided in relation to the first selector valve 22, and a pilot valve 100, in relation to the second selector valve 24. The pilot valves 98 and 100 are connected to a discharge flow passage 112 of a pump 106 via a flow passage 104, and to the supply flow passage 37 via a flow passage 102. The supply flow passage 37 and the flow passage 104 are connected via a pump 106, a check valve 108, a fluid pressure reservoir 110 and a relief valve 114. The pilot valve 98 and the first selector valve 22 are connected via pilot flow passages 116 and 118. Accordingly, when the pilot valve 98 is operated and the pilot pressure Pa in the pilot flow passage 116 increases, the action of the pilot pressure Pa brings the first selector valve 22 to a first operative position (the position moved downwardly in FIG. 2) from the neutral position shown in FIG. 2. At the first operative position, the feed flow passage 38 communicates with the first flow passage 26 via the fifth flow passage 60 and simultaneously, the second flow passage 28 communicates with the return flow passage 40. Furthermore, the fifth flow passage 60 communicates with the load-detecting flow passage 66. At the first operative position, the first selector valve 22 shuts off the flow passage 104. On the other hand, when the remote control valve 98 is operated and the pilot pressure Pb in the pilot flow passage 118, the action of the pilot pressure Pb brings the first selector valve 22 to a second operative position (the position moved upwardly in FIG. 2) from the neutral position. At the second operative position, the feed flow passage 38 communicates with the second flow passage 28 through the fifth flow passage 60 and the first flow passage 36 communicates with the return flow passage 40. Furthermore, the fifth flow passage 60 communicates with the load-detecting flow passage 66. At the second operative position, the first selector valve 22 shuts off the flow passage 104. As shown in FIG. 2, when the first selector valve 22 is at the neutral position, it shuts off communication of the feed flow passage 38 and the return passage 40 with the first flow passage 26 and the second flow passage 28, and on the other hand, opens the flow passage 104 (the load-detecting flow passage 66 communicates with the return flow passage 40). The remote control valve 100 and the second selector valve 24 are connected via pilot flow passages 120 and 122. Hence, when the remote control valve 100 is operated and the pilot pressure Pc (first pilot pressure) in the pilot flow passage 120 increases, the action of the pilot pressure Pc brings the second selector valve 24 to a first operative position (the position moved downwardly in FIG. 2) from the neutral position shown in FIG. 2. At the first operative position, the feed flow passage communicates with the third flow passage 30 via the sixth flow passage 62 and at the same time, the fourth flow passage 32 communicates with the return passage 40. Furthermore, the sixth flow passage 62 communicates with the load-detecting flow passage 68. Furthermore, at the first operative position, the second selector valve 24 shuts off the flow passage 104. On the other hand, when the pilot valve 100 is operated and the pilot pressure Pd (second pilot pressure) in the pilot flow passage 122 increases, the action of the pilot pressure Pd brings the second selector valve 24 to a second operative position (the position moved upwardly in FIG. 2) from the neutral position. At the second operative position, the feed flow passage 38 communicates with the fourth flow passage 32 via the sixth flow passage 62 and the third flow passage 30 communicates with the return flow passage 40. Furthermore, the sixth flow passage 62 communicates with the load-detecting flow passage 68. At the second operative position, the second selector valve 24 shuts off the flow passage 104. As shown in FIG. 2, the second selector valve 24 at the neutral position shuts off communication of the feed flow passage 38 and the return flow passage 40 with the third flow passage 30 and the fourth flow passage 32, and on the other hand, opens the flow passage 104 (the load-detecting flow passage 66 communicates with the return flow passage 40).

In the fluid pressure control system in the illustrated embodiment, the pressure of the fluid fed through the sixth flow passage 62 is reduced by the action of a pressure reducing valve 124. The pressure reducing valve 124 is disposed downstream of the second flow control valve 58 disposed in the sixth flow passage 62, and the fluid pressure in the load-detecting flow passage 68 acts on the pressure reducing valve 124 as a pilot pressure. The pressure reducing valve 124 is constructed of a proportional pressure reducing valve. When the fluid pressure on the primary side of the pressure reducing valve 124 becomes higher than the sum of the pressure of a spring **124*a* and the pilot pressure (the fluid pressure in the load-detecting flow passage 68), the pressure reducing valve 124 reduces the fluid pressure on the primary side to a value corresponding to the sum of the pressure of the spring 124*a* and the pilot pressure, and feeds the reduced pressure to the outlet side. The fluid pressure in the load-detecting flow passage 68 is adjusted by a relief valve 126. In the illustrated embodiment, the pilot flow passages 120 and 122 are connected to a shuttle valve 128A flow passage 130 communicating with a large chamber of the relief valve 126, i.e. a spring chamber 126*a* including a spring 126*c*, is connected to the shuttle valve 128. The shuttle valve 128 transmits the fluid pressure of the pilot flow passage 120 or the fluid pressure of the pilot flow passage 122, whichever is higher, to the large chamber 126*a* of the relief valve 126 through the flow passage 130. The load-detecting flow passage 68 communicates with a small chamber 126*b* in the relief valve 126 via a flow passage 132. Furthermore, the relief valve 126 and the return flow passage 40 are connected via a flow passage 134. The relief valve 126 is constructed of a proportional pressure relief valve which maintains the fluid pressure in the load-detecting flow passage 68 at a predetermined ratio to the pilot pressure acting on the spring chamber 126*a*. When the force due to the fluid pressure in the small chamber 126*b* becomes larger than the sum of the force due to the spring 126*c* and the force due to the fluid pressure in the large chamber 126*a*, the relief valve 126 is opened to conduct the fluid in the load-detecting flow passage 68 to the return flow passage 40 through the flow passages 132 and 134**.

In the illustrated embodiment, a third selector valve 136 is disposed downstream of the load-detecting flow passage 68, specifically the connecting part of the flow passage 132 and the pilot pressure taking part of the pressure reducing valve 124, and adapted to be selectively held at a communicating position (the position shown in FIG. 2) at which it communicates with the load-detecting flow passage 68 and a shutting position (the position shown in FIG. 3) at which it shuts off the load-detecting flow passage 68 (in the illustrated embodiment, the selector valve 136 at the shutting position permits the downstream portion of the load detecting flow passage 68, i.e. that portion of the flow passage 68 which is downstream of the third selector valve 136, to communicate with the return flow passage 40 via part of the flow passage 104). The pilot flow passage 118 is connected to the third selector valve 136, and therefore, when the pilot pressure Pb in the pilot flow passage 118 increases, the third selector valve 118 is brought to the shutting position from the communicating position. To switch the third selector valve 136 by the pilot pressure Pa, the pilot flow passage 116, instead of the pilot flow passage 118, may be connected to the third selector valve 136.

The operation and advantage of the fluid control system described above will be described.

Figure 4:
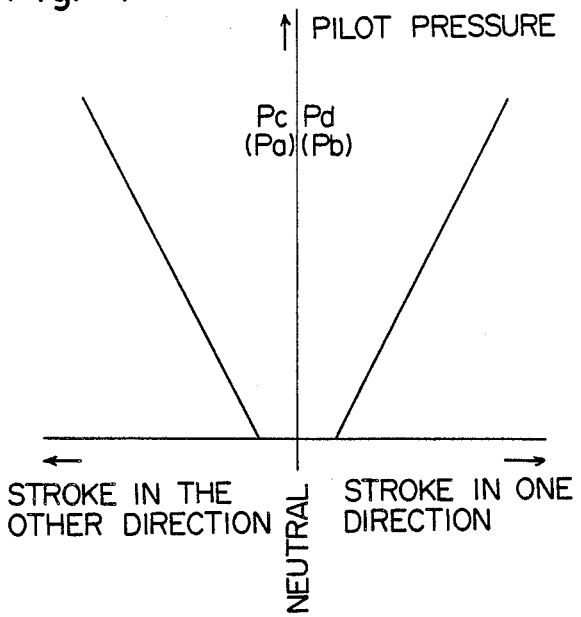
FIG. 4 is a diagram showing the relation between the stroke of a pilot valve which actuates the selector valve and the pilot pressure in the fluid pressure control system of FIG. 2.

The boom 10 (FIG. 1) may be actuated upwardly (or downwardly) by operating the pilot valve 98 to exert the pilot pressure Pb (or the pilot pressure Pa) on the first selector valve 22 and holding the first selector valve 22 at the second operative position (or the first operative position) (the relation between the stroke of the operating lever of the remote control valve 98 and the pilot pressures Pa and Pb is as shown in FIG. 4). As a result, the feed flow passage 38 communicates with the second flow passage 28 (or the first flow passage 26) via the first selector valve 22, the fifth flow passage 60 and the first flow control valve 22 and the first flow passage 26 (or the second flow passage 28 communicates with the return flow passage 40 via the first selector valve 22. Accordingly, the fluid supplied from the variable displacement pump 36 is fed to the extending side (or the retracting side) of the fluid pressure cylinder mechanism 12 through the second flow passage 28 (or the first flow passage 26). The fluid in the retracting side (or the extending side) of the fluid pressure cylinder mechanism 12 is returned to the return flow passage 40 through the first flow passage 26 (or the second flow passage 28). Thus, the fluid pressure cylinder mechanism 12 is extended (or retracted). In the illustrated embodiment, the first selector valve 22 includes a plurality of orifices, and the fluid fed to the fifth flow passage 60 at the first and second operative positions and the fluid returned to the return flow passage 40 at the first operative position are affected by orifices. Furthermore, at this time, the fluid pressure in the load-detecting flow passage 66 of the first selector valve 22 is transmitted to the main load-detecting flow passage 64 via the shuttle valve 74 and the flow passage 78. The fluid fed to the load-detecting flow passage 66 is also affected by the orifices.

The upper swing frame 6 (FIG. 1) may swing in a predetermined direction (for example, a right direction or an opposite direction) by operating the pilot valve 100 to apply the pilot pressure Pc (or the pilot pressure Pd) on the second selector valve 24 and holding the second selector valve 24 at the first operative position (or the second operative position) (the relation between the stroke of the operating lever of the remote control valve and the pilot pressures Pc and Pd is as shown in FIG. 4). As a result, the feed flow passage 38 communicates with the third flow passage 30 (or the fourth flow passage 32) via the second selector valve 24, the sixth flow passage 62, the second flow control valve 58 and the pressure reducing valve 124, and the fourth flow passage 32 (or the third flow passage 30) communicates with the return flow passage 40 via the second selector valve 24. Hence, the fluid fed from the variable displacement pump 36 is fed to the fluid pressure motor 8 through the third flow passage 30 (or the fourth flow passage 32), and the fluid in the fluid pressure motor 8 is returned to the return flow passage 40 through the fourth flow passage (or the third flow passage 30). Thus, the fluid pressure motor 8 is rotated in a predetermined direction (or a direction opposite to the predetermined direction). In the illustrated embodiment, the second selector valve 24 includes a plurality of orifices and check valves 160 and 162, and the second flow rate control valve 58 also includes an orifice. Accordingly, the fluid fed to the sixth flow passage 62 at the first and second operative positions is affected by the orifices of the second selector valve 24, and the fluid fed to the pressure reducing valve 124 is affected by the orifice of the second flow rate control valve 58. When the second selector valve 24 is at the first and second positions, the reverse flowing of the fluid from the third flow passage 30 to the sixth flow passage 62 and the reverse flowing of the fluid from the fourth flow passage 32 to the sixth flow passage 62 are exactly blocked by the check valves 160 and 162. At this time, the fluid pressure in the load-detecting flow passage 68 of the second selector valve 24 is transmitted to the main load-detecting flow passage 64 via the third selector valve 136, the shuttle valve 74 and the flow passage 78. The fluid fed to the load-detecting flow passage 69 is also affected by a throttling action.

The illustrated fluid pressure control system further has the following characteristic feature.

Figure 7:
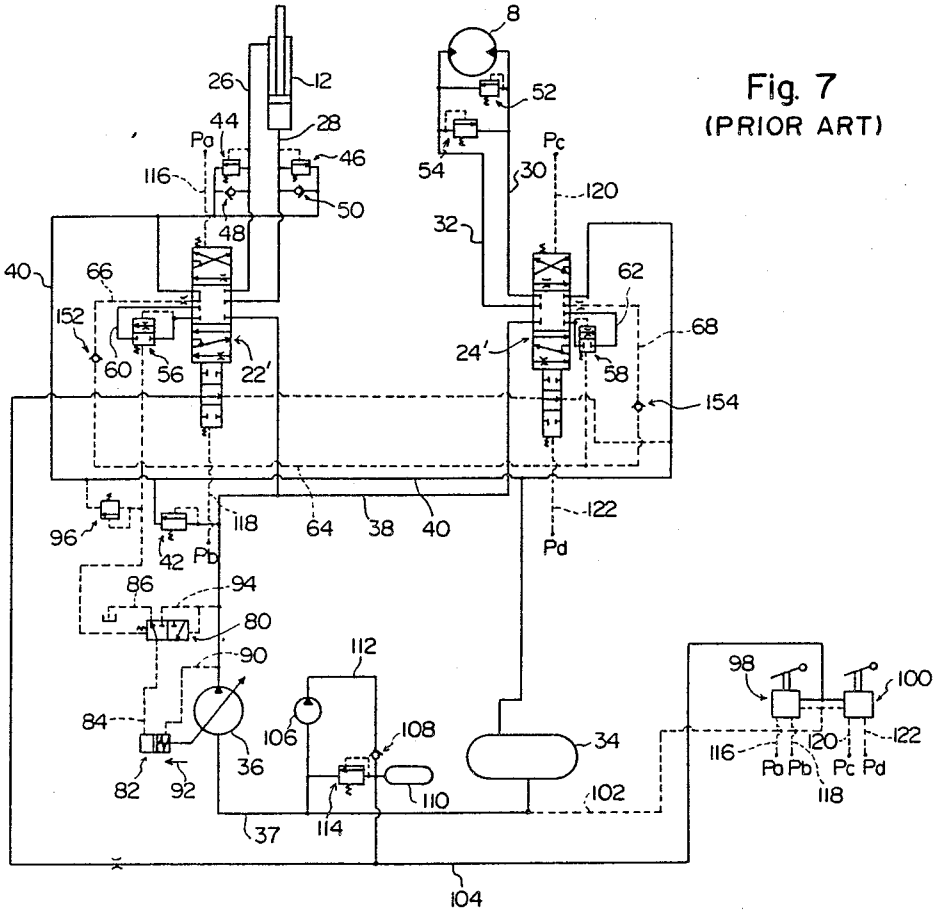
Fig. 7 (PRIOR ART)
FIG. 7 is a fluid pressure circuit diagram showing a conventional fluid pressure control system.

In the conventional fluid control system shown in FIG. 7 (substantially the same members as the members shown in FIG. 2 are designated by the same reference numerals), the following problem exists in relation to the fact that it has no reducing valve nor relief valve. As can be understood from FIG. 7, when a second selector valve 24' is at a first or second operative position and the rotation of the output shaft of the fluid pressure motor 8 is restrained by a large load to decrease the rotating speed of the output shaft, the flow rate of the fluid flowing through the second selector valve 24' is regulated. Consequently, the fluid pressure of the primary side of the second flow control valve 58 is not substantially reduced by the action of orifices included in the second selector valve 24' but is elevated up to the discharge pressure of the variable displacement pump 36. When the fluid pressure of the primary side of the second flow control valve 58 is so elevated, the control valve 58 is at an open position and opens the sixth flow passage 62 to a maximum. The fluid pressure on the outlet side of the second flow control valve 58 is also elevated to the discharge pressure of the variable displacement pump 36. As a result, the discharge pressure is transmitted to the main load-detecting flow passage 64 via the load-detecting flow passage 69 and the check valve 164, and the cylinder 82 is moved to the amount increasing side shown by arrow 92. The amount of discharge from the variable displacement pump 36 thus increases. Accordingly, when the output shaft of the fluid pressure motor 8 is restrained by some external load during the swinging of the upper swing frame 6 at a low speed, the fluid pressure of the outlet side of the second flow control valve 58 rises abruptly as stated above, and the output shaft of the fluid pressure motor 8 for swinging the upper swing frame 6 is rotated with a strong torque. Consequently, the fine-controllability of the upper swing frame 6 is difficult.

Figure 5:
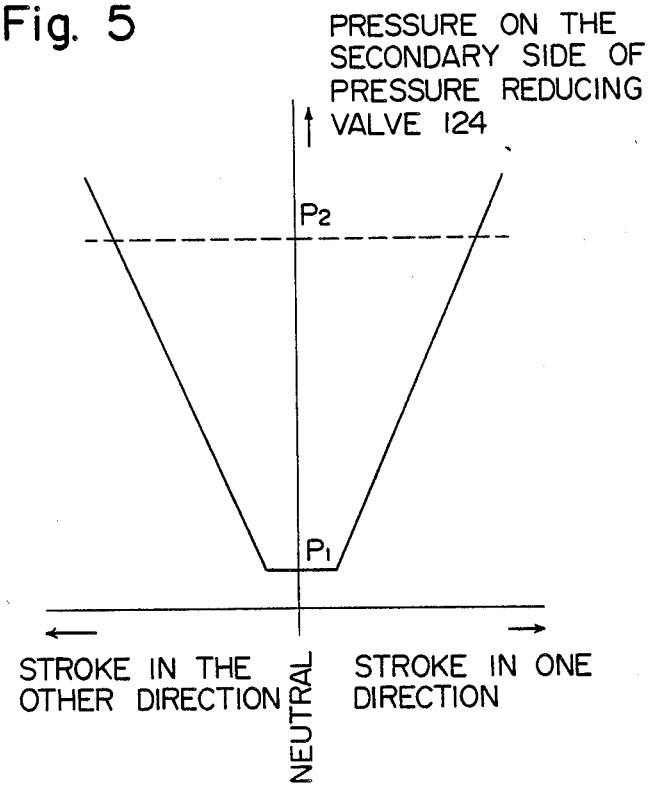
FIG. 5 is a diagram showing the relation between the stroke of the pilot valve and the outlet pressure of the pressure reducing valve.

In contrast, since in the illustrated fluid pressure control system in accordance with this invention, the pressure reducing valve 124 and the relief valve 126 are provided, the fine-controllability of the upper swing frame 6 can be markedly enhanced. Specifically, in the illustrated embodiment, the pilot pressure Pc or the pilot pressure Pd, which ever is higher, is transmitted to the large chamber **126*a* of the relief valve 126 via the shuttle 128 and the flow passage 130. On the other hand, the fluid pressure in the load-detecting flow passage 68, or in other words, in the third flow passage 30 (or the fourth flow passage 32) is transmitted to the small chamber 126*b* of the relief valve 126 via the orifices and the flow passage 132, and the pressure transmitted to the relief valve 126 acts as a pilot pressure on the pressure reducing valve 124. Accordingly, if the pilot pressure Pc (or the pilot pressure Pd) is high, the pressure acting on the large chamber 126*a* of the relief valve 126 also becomes high. As a result, the relief valve 126 becomes difficult to open and the fluid pressure in the load-detecting flow passage 68 is elevated. On the other hand, if the pilot pressure Pc (or the pilot pressure Pd) is low, the pressure acting on the large chamber 126*a* of the relief valve 126 also becomes low. As a result, the relief valve 126 can be opened even with a relatively low pressure from the flow passage 132, and the elevation of the fluid pressure in the load-detecting flow passage 68 is circumvented. Thus, the fluid pressure on the outlet side of the pressure reducing valve 124 is affected by the fluid pressure in the load-detecting flow passage 68 acting as a pilot pressure and becomes lower than a pressure varying in a straight line in substantial proportion to the pilot pressure Pc (or the pilot pressure Pd) as shown by a solid line in FIG. 5. FIG. 5 shows the relation between the stroke of the pilot valve 100 and the maximum fluid pressure on the outlet side of the pressure reducing valve 124. The pressure $P_1$ is a fluid pressure determined by the pressure of the spring 126*c* of the relief valve 126 and the pressure of the spring 124*a* of the pressure reducing valve 124, and the pressure $P_2$ is a pressure set by the relief valve 52 (or the relief valve 54). Accordingly, even if the output shaft of the fluid pressure motor is restrained by some external load, the action of the pressure reducing valve 124 suppresses the elevation of the fluid pressure (the pressure on the outlet side of the pressure reducing valve 124) fed to the fluid pressure motor 8. As a result, the output shaft of the fluid pressure motor 8 is not rotated with a strong torque as in the prior art, and the upper swing frame 6** can be micro-operated finely as is desired.

When the first selector valve 22 is held at the first operative position and the second selector valve 24 at the first operative position (or the second operative position) in order to operate the upper swing frame 6 and the boom 10 simultaneously, the feed flow passage 38 communicates with the first flow passage 26 via the first selector valve 22, the fifth flow passage 60 and the first flow control valve 56 and the second flow passage 28 communicates with the return flow passage 40 via the first selector valve 22. Furthermore, the feed flow passage 38 communicates with the third flow passage (or the fourth flow passage 32) via the second selector valve 24, the sixth flow passage 62, the second flow control valve 58 and the pressure reducing valve 124, and the fourth flow passage 32 (or the third flow passage 30) communicates with the return flow passage 40 via the second selector valve 24. As a result, the fluid from the variable displacement pump 36 is fed to the rod side of the fluid pressure cylinder mechanism 12 via the first flow passage 26 and the fluid on the head side of the cylinder mechanism 12 is returned to the return flow passage via the second flow passage 28. Thus, the fluid pressure cylinder mechanism 12 is retracted as is required. Furthermore, the fluid from the variable delivery pump 36 is fed to the fluid pressure motor 8 via the third flow passage 30 (or the fourth flow passage 32), and the fluid of the fluid pressure motor 8 is returned to the return flow passage 40 via the fourth flow passage 32 (or the third flow passage 30). Thus, the fluid pressure motor 8 is rotated in a predetermined direction (or a direction opposite to the predetermined direction). At this time, the fluid pressure described below acts on the main load-detecting flow passage 64.

Specifically, since the third selector valve 136 is at the communicating position, the fluid pressure in the load-detecting flow passage 66 of the first selector valve 22 acts on one side of the shuttle valve 74, and the fluid pressure in the load-detecting flow passage 68 of the second selector valve 24 acts on the other side of the shuttle valve 74 via the third selector valve 136. The shuttle valve 74 transmits the fluid pressure in the load-detecting flow passage 66 or the fluid pressure in the load-detecting flow passage 68, whichever is higher, to the main load-detecting flow passage 64.

Figure 3:
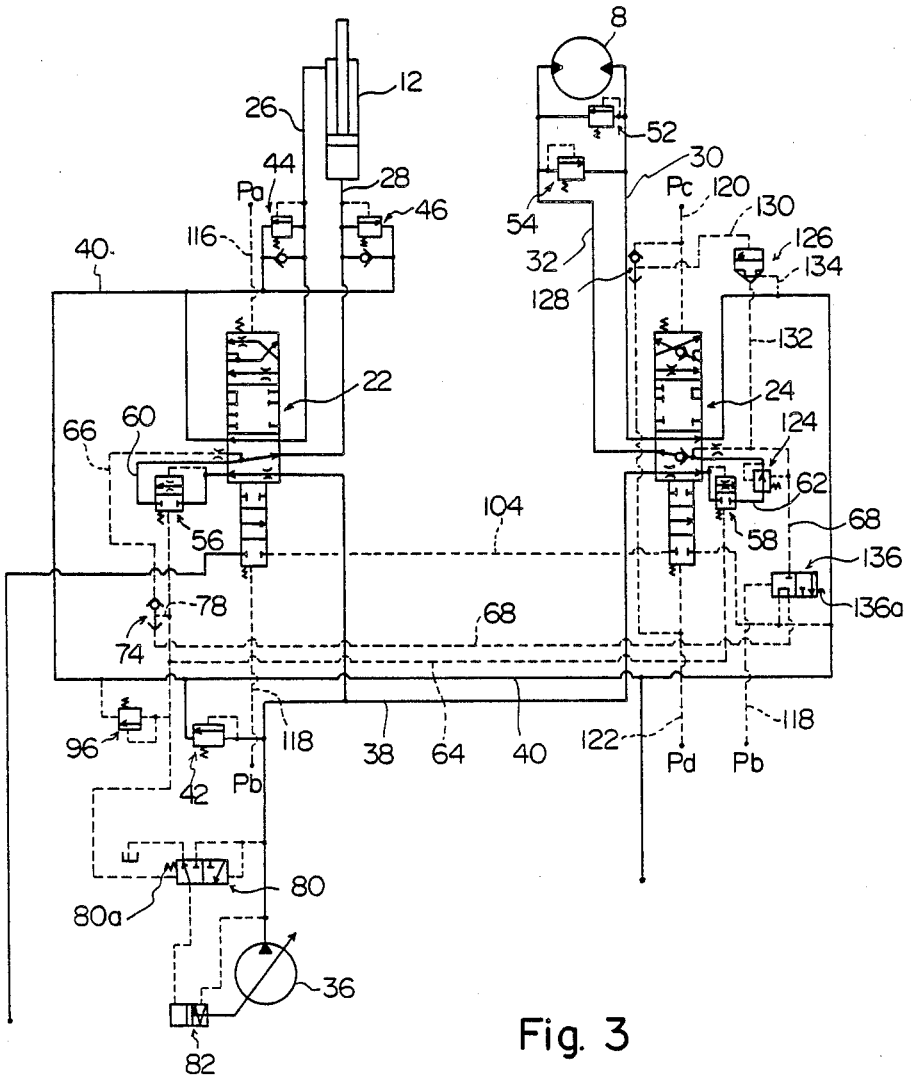
FIG. 3 is a partial fluid pressure circuit diagram showing the first and second selector valves as they are held at the second operating positions in the fluid pressure control system shown in FIG. 2.

When the first selector valve 22 is held at the second operative position and the second selector valve 24 is held at the second operative position (or the first operative position) in order to operate the upper swing frame 6 and the boom 10 simultaneously, the feed flow passage 38 communicates with the second flow passage 28 via the first selector valve 22, the fifth flow passage 60 and the first flow control valve 56 and the first flow passage 26 communicates with the return flow passage 40 via the first selector valve 22 and further the feed flow passage 38 communicates with the fourth flow passage 32 (or the third flow passage 30) via the second selector valve 24, the sixth flow passage 62, the second flow control valve 58 and the pressure reducing valve 124 and also the third flow passage 30 (or the fourth flow passage 32) communicates with the return flow passage 40 via the second selector valve 24, as shown in FIG. 3 (FIG. 3 only shows the case where the second selector valve 24 is at the second operative position). As a result, the fluid from the variable displacement pump 36 is fed to the head side of the fluid pressure cylinder mechanism 12 via the second flow passage 28 and the fluid in the rod side of the fluid pressure cylinder mechanism 12 is returned to the return flow passage 40 via the first flow passage 26. Thus, the fluid pressure cylinder mechanism 12 is extended as is required. Furthermore, the fluid from the variable displacement pump 36 is fed to the fluid pressure motor 8 via the fourth flow passage 32 (or the third flow passage 30) and the fluid of the fluid pressure motor 8 is returned to the return flow passage 40 via the third flow passage 30 (or the fourth flow passage 32). The fluid pressure motor 8 is thus rotated in a direction opposite to the predetermined direction (or in the predetermined direction).

When in order to hold the first selector valve 22 at the second operative position, the pilot valve 98 is operated to elevate the pilot pressure Pb (specifically, the pilot pressure Pb exceeds a preset pressure of the spring 136*a* of the third selector valve 136), the action of the pilot pressure Pb brings the third selector valve 136 to the shutting position from the communicating position. As a result, the load-detecting flow passage 68 of the second selector valve 24 is shut off, and the other side of the shuttle valve 74 is connected to the return flow passage 40 via the third selector valve 136. The fluid pressure of the load-detecing flow passage 66 of the first selector valve 22 is transmitted to the main load-detecting flow passage 64 via the shuttle valve 74 and the flow passage 78.

The fluid pressure control system in the illustrated embodiment also has the following characteristic feature.

Figure 6:
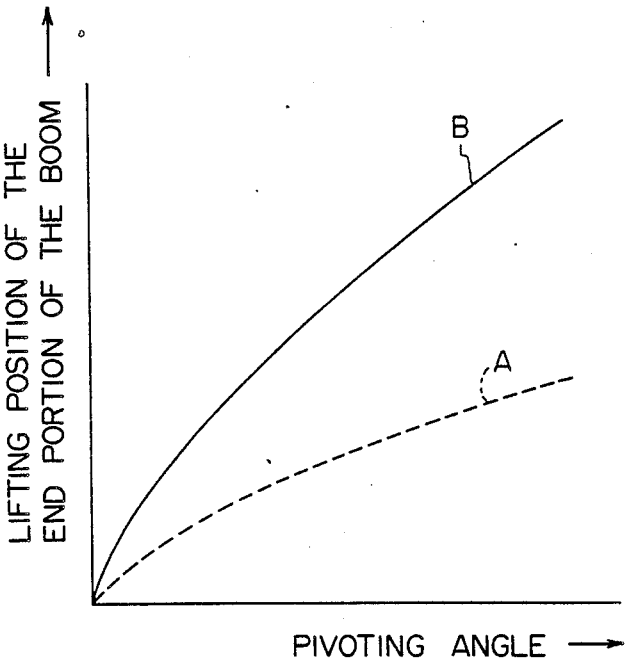
FIG. 6 is a diagram showing the relation between the swing angle of the upper swing frame and the lifting height of the end portions of the boom, the dotted line showing the prior art and the solid line showing the invention.

When, in the conventional fluid pressure control system shown in FIG. 7, the operation of raising the boom 10 and the operation of swinging the upper swing frame 6 are carried out fully (the pilot valves 98 and 100 are fully operated), a large load acts on the fluid pressure motor 8 at the time of starting the swinging of the upper swing frame 6 because the upper swing frame 6 has a greater inertia. As a result, the rotating speed of the liquid pressure motor 8 is low, and the flow rate of the fluid flowing through the second selector valve 24' is regulated. The pressure on the primary side of the second flow rate control valve 58 rises and accordingly, the pressure on the secondary side of the second flow control valve 58 also rises. Thus, the fluid pressure fed to the fluid pressure motor 8 from the second flow control valve 58 reaches a pressure preset in the relief valve 52 (or 54). On the other hand, the fluid pressure fed to the head side of the fluid pressure cylinder mechanism 12 which corresponds to the force to lift the boom 10 is usually lower than the pressure preset at the relief valve 52 (or 54). Hence, the fluid pressure in the load-detecting flow passage 68 of the second selector valve 24' is transmitted to the main load-detecting flow passage 64 via the check valve 154, and the fluid pressure motor 8 is driven by the pressure set at the relief valve 52 (or 54). Accordingly, the rotating torque of the fluid pressure motor 8 is high, and the swinging speed of the upper swing frame 6 after a predetermined period of time becomes much faster than the raising speed of the boom 10. The relation between the swinging angle of the upper swing frame 6 and the lifting position of the end portion of the boom 10 forms the locus shown by dotted line A in FIG. 6, which is a relatively low curve. Thus, the upper swing frame 6 swings faster than the boom 10 rises, and the bucket may collide with a relatively low structure existing within the swinging range of the upper swing frame 6.

In contrast, in the fluid control system of the illustrated embodiment of the invention, the third selector valve 136 is disposed in the load-detecting flow passage 58 of the second selector valve 24, and is held at the shutting position by the pilot pressure Pb at the time of full operation of lifting the boom 10 (FIG. 1). Thus, the main load-detecting flow passage 64 is not at all affected by the fluid pressure in the load-detecting flow passage 68 of the second selector valve 24 but is affected by the fluid pressure in the main load-detecting flow passage 66 of the first selector valve 22. The discharge pressure of the variable displacement pump 36 equals the sum of the fluid pressure of the main load-detecting flow passage 64 (therefore, the fluid pressure of the head side of the fluid pressure cylinder mechanism 12) and the pressure of the spring 80*a* of the selector valve 80. Generally, the pressure of the spring 80*a* is low, and the discharge pressure of the pump 36 is lower than the pressure set at the relief valve 52 (or 54). On the other hand, when the pilot valve 100 is fully operated, the upper limit of the fluid pressure on the outlet side of the pressure reducing valve 112 is close to, or higher than, the pressure set at the relief valve 52 (or 54), as shown in FIG. 5. Accordingly, the fluid from the variable displacement pump is not substantially affected by the pressure reducing valve 124, and is fed to the third flow passage 30 (or the fourth flow passage 32) through the pressure reducing valve 124. The pressure of the fluid fed to the fluid pressure motor 8 is lower than in the conventional system, and the swinging speed of the upper swing frame 6 becomes lower than in the conventional system. Thus, the relation between the swinging angle of the upper swing frame 6 and the raising position of the end portion of the boom 10 forms the locus shown by solid line B in FIG. 6 which is a relatively high curve. Accordingly, the elevation of the boom 10 and the swinging of the upper swing frame 6 can be performed as the operator intends, and collision of the bucket 18 with a low structure, etc. during the swinging of the upper swing frame 6 can be circumvented.

While the present invention has been described above with reference to one specific embodiment of the fluid pressure control system constructed in accordance with the invention, it should be understood that the invention is not limited to this specific embodiment, and various changes and modifications are possible without departing from the scope of the invention described and claimed herein.

For example, the above embodiment has been described with reference to its application to a hydraulic excavator. This is not limitative, and for example, the invention can equally be applied to a crane for cargo handling operation.

I claim:

1. A fluid pressure control system comprising a variable displacement pump of which amount of discharge is variable, a first selector valve adapted to be selectively held at any one of a neutral position, a first operative position and a second operative position, a second selector valve adapted to be selectively held at any one of a neutral position, a first operative position and a second operative position, a first actuator of which action is to be controlled by the shifting operation of the first selector valve, a second actuator of which action is to be controlled by the shifting operation of the second selector valve, a first flow control valve for controlling a fluid to be supplied to the first actuator, a second flow control valve for controlling a fluid to be supplied to the second actuator, a feed flow passage connecting the variable displacement pump to the first and second selector valves, a return flow passage connected to the first and second selector valves, first and second flow passages connecting the first selector valve to the first actuator, third and fourth flow passages connecting the second selector valve and the second actuator, and a main load-detecting flow passage for controlling the amount of discharge of the variable displacement pump, the first selector valve at the first operative position permitting communication of the feed passage with the first flow passage and also the return flow passage with the second flow passage, the first selector valve at the second operative position permitting communication of the feed passage with the second flow passage and also the return flow passage with the first flow passage, the first selector valve at the neutral position shutting off communication of the feed flow passage and the return flow passage with the first flow passage and the second flow passage, the second selector valve at the first operative position permitting communication of the feed passage with the third flow passage and also the return flow passage with the fourth flow passage, the second selector valve at the second operative position permitting communication of the feed passage with the fourth flow passage and also the return flow passage with the third flow passage, the second selector valve at the neutral position shutting off communication of the feed flow passage and the return flow passage with the third flow passage and the fourth flow passage, the first flow control valve being adapted to control a fluid to be supplied to the first or second flow passage from the feed flow passage when the first selector valve is at the first or second operative position, and the second flow control valve being adapted to control a fluid to be supplied to the third or fourth flow passage from the feed flow passage when the second selector valve is at the first or second operative position;

wherein a pressure reducing valve and a relief valve are disposed in relation to the second flow control valve, the pressure reducing valve having a primary side and a secondary side wherein the pressure reducing valve reduces the pressure of the fluid supplied to the second actuator through the second selector valve, and the pressure on the secondary side of the pressure reducing valve is controlled by the action of the relief valve which is controlled by an external pilot pressure.

2. The fluid pressure control system of claim 1 in which the relief valve is disposed between the return flow passage and a load-detecting flow passage in the second selector valve.

3. The fluid pressure control system of claim 2 in which the operation of the second selector valve is controlled by first and second pilot pressures and one of the first and second pilot pressures, whichever is higher, acts on a spring chamber in the relief valve.

4. The fluid pressure control system of claim 3 in which the relief valve is a proportional pressure relief valve which adjusts the ratio of the pressure in the load-detecting flow passage of the second selector valve to the pilot pressure acting on the spring chamber to a predetermined value.

5. The fluid pressure control system of claim 2 in which the fluid pressure in the load-detecting flow passage of the second selector valve acts on the pressure reducing valve as the pilot pressure.

6. The fluid pressure control system of claim 5 in which the pressure reducing valve is a proportional pressure reducing valve which reduces the fluid pressure on the primary side on the basis of the pilot pressure.

7. The fluid pressure control system of claim 1 in which a load-detecting flow passage in the first selector valve and a load-detecting flow passage in the second selector valve are connected to the main load-detecting flow passage through a shuttle valve, and one of the fluid pressure in the load-detecting flow passage of the first selector valve and the fluid pressure in the load-detecting flow passage in the second selector valve, whichever is higher, is transmitted to the main load-detecting flow passage via the shuttle valve.

8. The fluid pressure control system of claim 7 in which a third selector valve is disposed in the load-detecting flow passage of the second selector valve, and the third selector valve is adapted to be selectively held at a communication position at which it renders the load-detecting flow passage communicative or at a shutting position at which it shuts off the load-detecting flow passage.

9. The fluid pressure control system of claim 8 in which the third selector valve is adapted to be held at the shutting position when the first selector valve is held at the first or second operative position.

10. The fluid pressure control system of claim 9 in which the operation of the first selector valve is controlled by an external pilot pressure, and the third selector valve is held at the shutting position by the external pilot pressure.

11. The fluid pressure control system of claim 1 in which the first actuator is a fluid pressure cylinder mechanism which vertically pivots a boom in a hydraulic excavator, and the second actuator is a fluid pressure motor for swinging an upper swing frame in the hydraulic excavator.

* * * * *